US007059970B1

(12) United States Patent
Hamburger

(10) Patent No.: US 7,059,970 B1
(45) Date of Patent: Jun. 13, 2006

(54) GOLF CLUB ALIGNMENT DEVICE

(76) Inventor: Edward Hamburger, 5472 Bristol Park Dr., Clarkston, MI (US) 48348

( * ) Notice: Subject to any disclaimer, the term of this patent is extended or adjusted under 35 U.S.C. 154(b) by 0 days.

(21) Appl. No.: 10/910,144

(22) Filed: Aug. 3, 2004

(51) Int. Cl.
*A63B 69/36* (2006.01)

(52) U.S. Cl. ..... 473/226; 473/219; 473/268

(58) Field of Classification Search ..... 473/206, 473/226–238, 266–269; D21/791
See application file for complete search history.

(56) References Cited

U.S. PATENT DOCUMENTS

| | | | | | |
|---|---|---|---|---|---|
| 3,758,117 | A * | 9/1973 | Harrison | 473/231 |
| 3,951,415 | A | 4/1976 | Stuart | |
| 4,167,268 | A | 9/1979 | Lorang | |
| 4,789,158 | A * | 12/1988 | Chiesa | 473/238 |
| 4,949,971 | A * | 8/1990 | Thornton | 473/238 |
| 4,953,867 | A * | 9/1990 | Rigsby | 473/238 |
| 5,178,394 | A * | 1/1993 | Tanampai | 473/316 |
| D347,457 | S * | 5/1994 | Armstrong, III | D21/791 |
| 5,441,273 | A * | 8/1995 | Stormon | 473/251 |
| 5,605,509 | A * | 2/1997 | Gray | 473/237 |
| 5,665,007 | A * | 9/1997 | Tatum | 473/238 |
| 5,762,564 | A * | 6/1998 | Schang | 473/238 |
| 6,022,278 | A | 2/2000 | Vela | |
| 6,447,401 | B1 | 9/2002 | Torkos | |

* cited by examiner

*Primary Examiner*—Nini F. Legesse
(74) *Attorney, Agent, or Firm*—MacMillan, Sobanski & Todd, LLC

(57) ABSTRACT

A golf club alignment device for aiding a user in striking a golf ball with a golf club having a head, shaft and handle. The alignment device includes a body having first and second ends. A clamp portion extends from the first end of the body and is adapted for resilient and removable attachment to the shaft of the golf club. The device further includes a sighting structure extending from the second end of the body. The sighting structure is configured having a width less than the diameter of the shaft.

20 Claims, 5 Drawing Sheets

GOLF CLUB ALIGNMENT DEVICE

BACKGROUND OF THE INVENTION

This invention relates in general to golfing equipment, and in particular to an alignment device for aiding a user of the golf club to properly align the striking face of a golf club with the intended path of ball travel.

When striking a golf ball, it is important to correctly align the striking face of the golf club with the intended travel direction of the ball. In order to correctly hit or strike the ball in the intended direction, the striking face of the golf club must be positioned at a normal angle relative to the intended travel direction of the ball. If the striking face of the golf club is not normal to the intended travel direction of the ball, the club will strike the ball at a non-perpendicular angle, thereby propelling the ball to the left or right of the intended travel direction. As the user swings the club, such as a putter, the head of the golf club swings in an arcuate path. The arcuate path lies generally in a vertically orienting plane. Preferably, the generally flat striking surface of the putter is perpendicular with the plane upon impact with the ball.

It is known to provide alignment devices to aid the user in properly orienting the striking face of the club relative to the intended travel direction of the ball. Some of these devices are attached to the shaft of the club. In one such known device, as is disclosed in U.S. Pat. No. 3,951,415, a golf putter sighting device is resiliently clamped to the shaft of the club. The sighting device includes a pair of spaced apart sights, such as colored beads, which extend outwardly from an elongated main body portion of the sighting device. The main body portion of the sighting device extends in a direction parallel to the striking face of the putter when properly positioned on the putter shaft. The pair of opposed sights extend outwardly from an end of the main body portion in a direction normal to the length of the main body. When properly attached to a putter shaft, each pair of sights are exposed when the user looks downwardly at the shaft. Thus, as the user looks downwardly at the shaft and sighting device, the main body portion is covered or hidden by the shaft but the sights are visible from the sides of the shaft. During swinging of the club, the user aligns the device such that the pair of sights are equally visible upon impact of the ball, thereby properly aligning the striking face of the club at a perpendicular direction with respect to the intended travel direction of the ball. However, maintaining or observing equally visible sights is typically difficult for most golfers. Also, the highly decorative color of the sights is often distracting to the golfer during the swing. Since the spaced apart sights are permanently at a set space or width apart, golfers of differing heights will not see the same visual indicators. For example, for taller golfers, the sights may not be spaced sufficiently apart from one another to see completely at the edges of the shaft. It is therefore desirable to provide an improved alignment device.

BRIEF SUMMARY OF THE INVENTION

This invention relates to in general to an alignment device for aiding a user of the golf club to properly align the striking face of a golf club with the intended path of ball travel. The alignment device includes a body having first and second ends. A clamp portion extends from the first end of the body and is adapted for resilient and removable attachment to the shaft of the golf club. The device further includes a sighting structure extending from the second end of the body. The sighting structure is configured having a width less than the diameter of the shaft.

In a preferred embodiment, the alignment device is provided in a kit further including a plurality of caps adapted to be individually mounted on the sighting structure Each of caps is configured with a different width or shape for altering the overall visual width of the sighting structure when the cap is mounted on the sighting structure.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
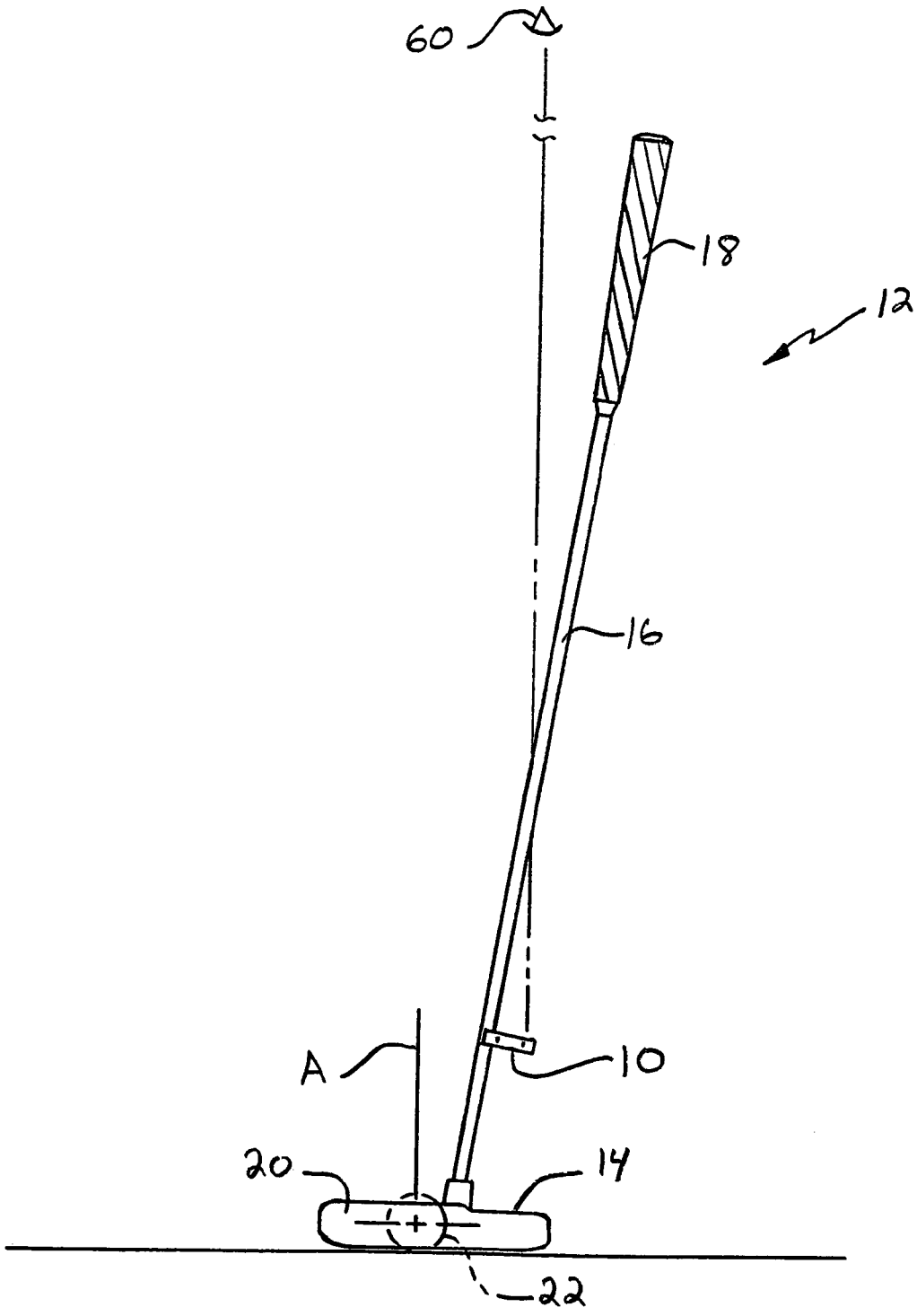
FIG. 1 is a schematical side elevational of a club having an alignment device, in accordance with the present invention, mounted thereon.

Referring now to the drawings, there is illustrated in FIG. 1 an alignment device 10, in accordance with the present invention, mounted on a golf club 12. As will be discussed in detail below, the alignment device 10 is a removable device for aiding the golfer or user of the club 12 to properly align the striking face of a golf club with the intended travel path of the ball.

It should be understood that the alignment device 10 can be used with any style of golf club, and is illustrated and described herein as being used in cooperation with a putter style golf club. The club or putter 12 generally includes a head 14, a shaft 16, and a grip or handle 18. The head 14 includes a generally flat planar striking face 20 for engaging with a golf ball 22. The striking face may be oriented in a generally vertical plane, such as is typical for a putter, or may be at an angle relative to a vertical plane, which is typical for iron and wood type clubs.

To strike the ball 22, the user swings the head 14 in an arcuate path such that head will travel a greater distance than the handle 18, since the user grips the club 12 by the handle 18. In a generally properly swung club, the arcuate path of the head 14 lies in a generally vertical plane, generally indicated at A in FIGS. 1 and 5. This arcuate path also represents the desired travel direction of the ball which the user wishes the ball to travel. As will be discussed below it is important for the user to align the striking face 20 of the head 14 with the intended travel direction A of the ball 22.

Figure 2:
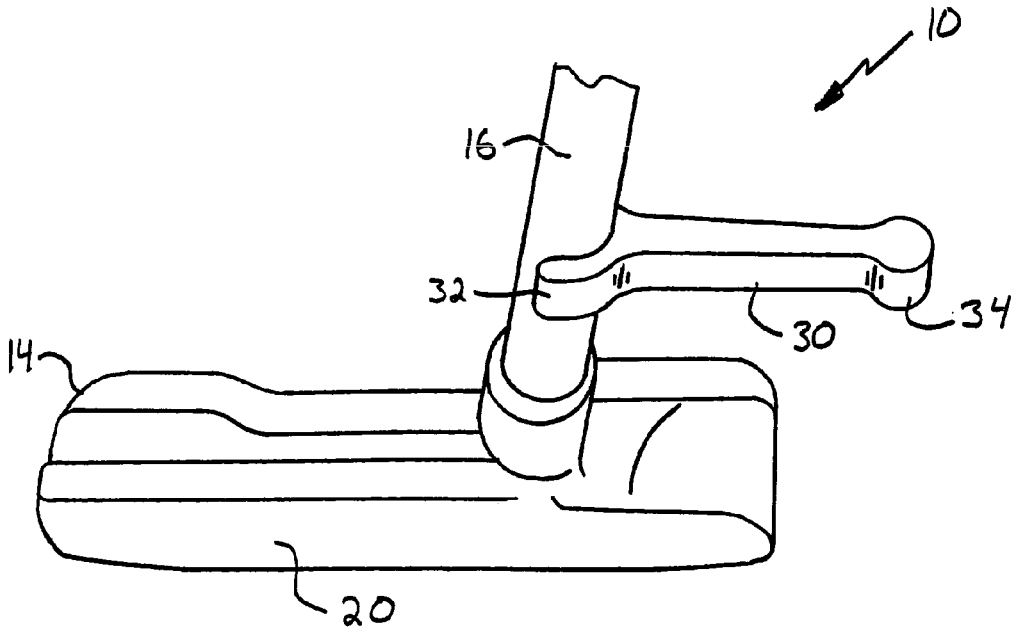
FIG. 2 is an enlarged perspective view of the alignment device of FIG. 1 mounted on the lower portion of the shaft of the club.
Figure 3:
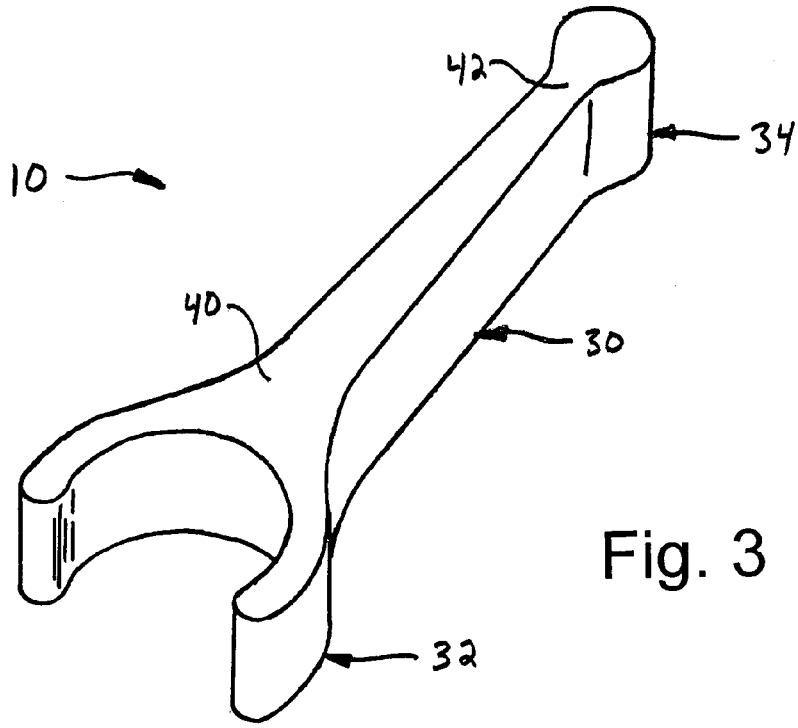
FIG. 3 is an enlarged perspective view of the alignment device of FIGS. 1 and 2.

An embodiment of the alignment device 10 is illustrated in FIGS. 1 through 6. As best shown in FIGS. 2 and 3, the alignment device 10 generally includes a body 30, a clamp portion 32, and a sighting structure 34. Preferably, the body 30, the clamp portion 32, and the sighting structure 34 are all integrally formed together as a single unit, although such is not required. The alignment device may be made of any suitable material, such as plastic. Preferably, the alignment device 10 is made of a relatively rigid material for maintaining the alignment device shape, while having resilient properties so that the clamp portion 32 may be resiliently snap fitted onto the shaft 16 of the club 12. Plastic is a suitable material for the alignment device 10.

The body 30 is generally elongated and can have any suitable cross-sectional shape for providing proper rigidity of the alignment device 10. In the embodiment shown, the body 30 has a generally rectangular cross sectional shape. Preferably, the width of the body as looking downwardly thereon, is less than, or more preferably substantially less than, the diameter of the shaft 16. This relatively small width is preferred so that the user does not view the body 30 and is obstructed completely by the shaft 16. The body 30 includes a first end 40 and a second end 42. The clamp portion 32 is attached to the first end 40.

The clamp portion 32 is preferably shaped so as to provide a resilient means for mounting the alignment device 10 on the shaft 16 of the club 12. In the embodiment shown in FIGS. 2 and 3, the clamp portion 32 has a generally C-shape defined by a pair of arcuate arms 50 and 52 extending outwardly from a web portion 54. The web portion 54 is attached to the first end 40 of the body 30. The arms 50 and 52 converge towards one another to form an open or broken ring. The ends 56 and 58 of the arms 50 and 52, respectively, are spaced apart from one another, and preferably are greater than one half the circumference of the shaft. The arms 50 and 52 define an inner diameter $D_1$ which is preferably less than the diameter $D_2$ of the shaft 16. To mount the alignment device 10 onto the shaft 16, the arms 50 and 52 are lightly resiliently spread apart from one another while receiving the shaft 16 therebetween until the arms 50 and 52 surround the shaft 16. Since the width $D_1$ defined by the arms 50 and 52 is less than the diameter $D_2$ of the shaft 16, the arms 50 and 52 function as spring members frictionally holding the alignment device 10 onto the shaft 16.

Figure 6:
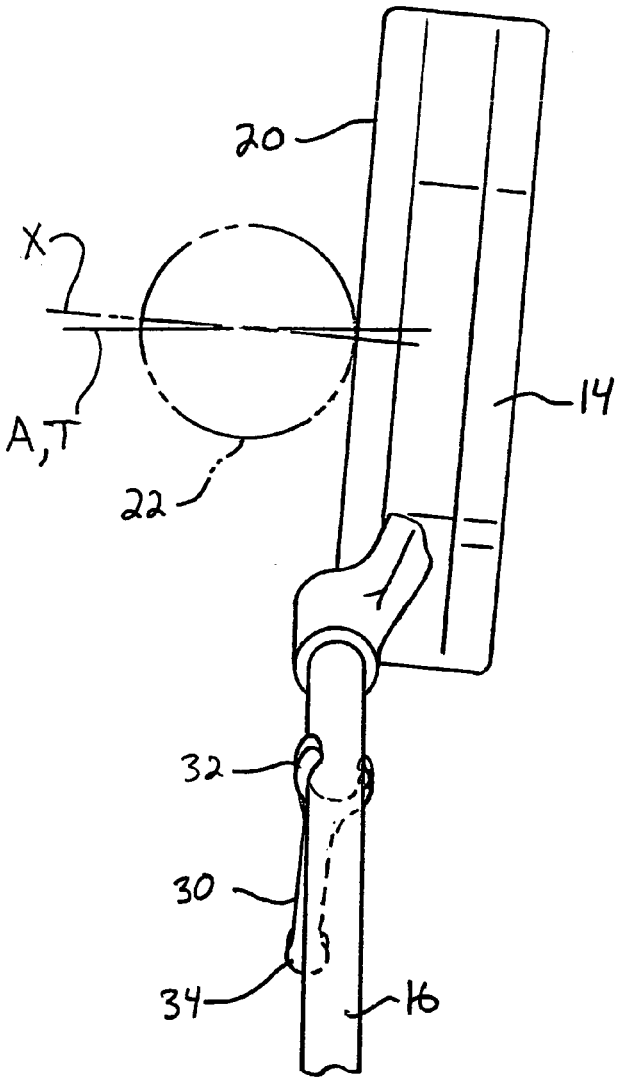
FIG. 6 is a plan view similar to FIG. 5 but with a misaligned club head illustrating that a portion of the sighting structure is visibly exposed.
Figure 7:
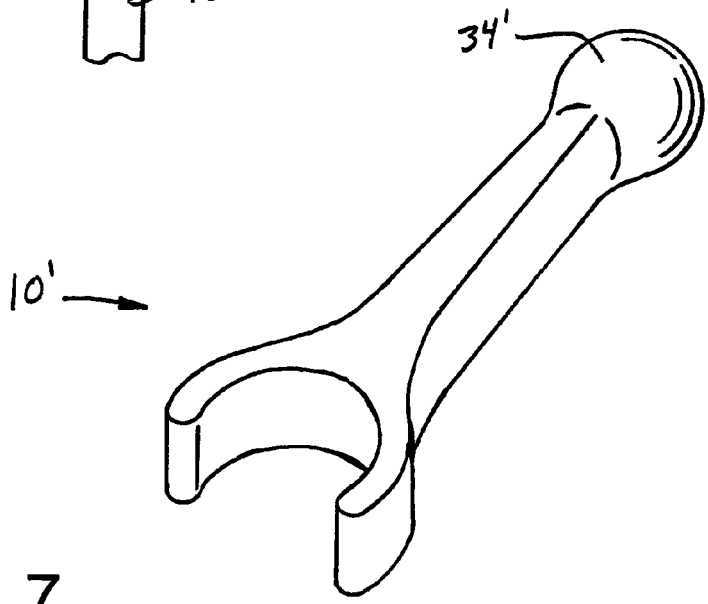
FIG. 7 is a perspective view of an alternate embodiment of an alignment device, in accordance with the present invention, in which the sighting structure has a spherical shape.

The sighting structure 34 is attached to the second end 42 of the body 30. The sighting structure 34 can have any suitable shape for assisting in aligning the alignment device 10 with the shaft 16 by the user, as will be described below. In the embodiment illustrated in FIGS. 1 through 6, the sighting structure is shaped in the form of a generally vertically oriented cylinder. When viewed from above, the sighting structure 34 is generally viewed as a circle. It should be understood that the sighting structure 34 can have any suitable shape. For example, there is illustrated in FIG. 7 an alternate embodiment of an alignment device 10' having a sighting structure 34' having a spherical shape.

Figure 4:
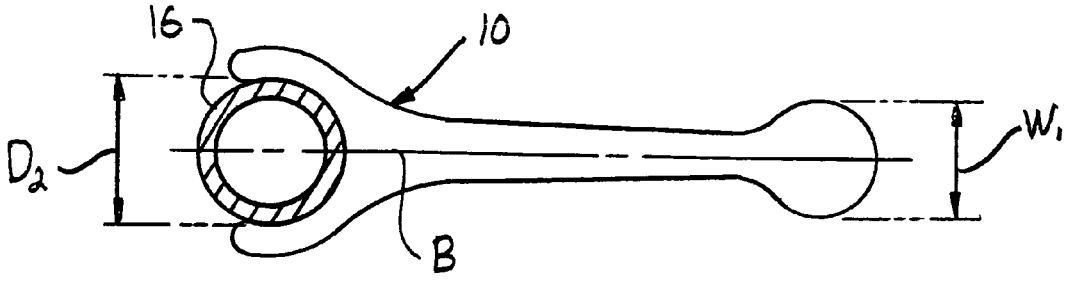
FIG. 4 is a plan view of the alignment device of FIGS. 1 through 3 with the club shaft shown in section.

Regardless of the shape of the sighting structure 34, the sighting structure 34 preferably has a width $W_1$ equal to or less than the diameter $D_2$ of the shaft 16. The width W1 is defined as the width taken along a perpendicular viewing point relative to an axis B defined by the elongated body 30, as best shown in FIG. 4.

During the swing of the club 12, the shaft 16 is held by the user at an angle relative to the horizontal, as best shown in FIG. 1. Thus, the shaft 16 is not held exactly or near vertical. The alignment device 10 is preferably mounted on the shaft 16 of the putter 10 at a lower portion thereof, as shown in FIG. 1. Thus, the alignment device 10 is positioned underneath the shaft 16 when viewed from above, as schematically indicated by an eye 60 of the user in FIG. 1. Thus, in a normal stance of a user of the club 12, the alignment device 10 is positioned underneath the shaft 16 as viewed from the position of the eye 60. Generally, even during the arcuate swing path of the club 12, the alignment device 10 is positioned underneath the shaft 16.

Figure 5:
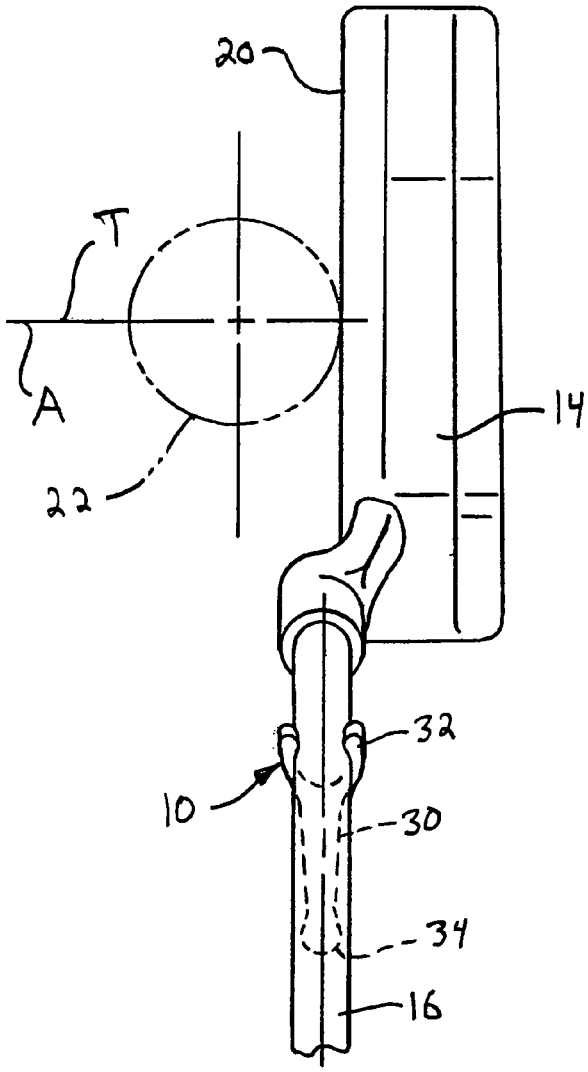
FIG. 5 is a plan view illustrating a properly positioned club head relative to the ball and intended travel direction with the sighting structure of the alignment device hidden underneath by the shaft.

The alignment device 10 should first be properly positioned with respect to the striking face 20 of the club 12. In most situations, the user will chose to align the alignment device 10 such that the axis B as defined by the body 30 is generally parallel to the striking face 20, as best shown in FIG. 5. Once the alignment device 10 has been properly positioned relative to the shaft 16, the user will initially line up the shaft 16 such that the shaft 16 is generally perpendicular to an intended travel direction T of the ball, which is co-planar with the arcuate axis A. The user than rotates the shaft 16 to orient the striking face 20 perpendicularly with the axes A and T. To accomplish this, the alignment device 10 should be oriented completely underneath the shaft 16, as shown in FIG. 5, such that the edges of the sighting structure 34 cannot be seen by the eye 60 of the user. Thus, the user simply rotates the shaft 16 until the sighting structure 34 is hidden from view by the shaft 16.

Once the user has proper alignment of the club 12, the user then swings the club 12 in the arcuate path reassuring that just prior to impact with the ball (after the back swing and then forward swing) that the sighting structure 34 is hidden by the shaft 16. If the user discovers that the sighting structure 34 is not hidden, but is offset, such as shown in FIG. 6, this indicates that the ball will not travel in the intended travel direction but at a direction X which is perpendicular to the striking face 20. The user can then practice his or her swing until systematically, the user properly positions the club so that the sighting structure is hidden from view by the shaft 16. Thus, the alignment device can be used as a practice aid to observe and correct improper swing arcs of the user.

However, it should be understood that the alignment device 10 may be positioned at any position the user so wishes. The alignment device 10 may be positioned offset relative to the striking face 20 or misaligned on purpose so as to compensate for the viewing angle of the user. Additionally, the user may chose to misalign the alignment device 10 because although the user properly aligns the striking face 20 during the beginning of the swing during initial line up, the user alters the position of the striking face during the back swing and upon contact with the ball 22. Due to the frictional engagement of the alignment device 10 to the shaft 16 via the clamping portion 32, the alignment device may easily be rotated or shifted into a desired position.

Figure 8:
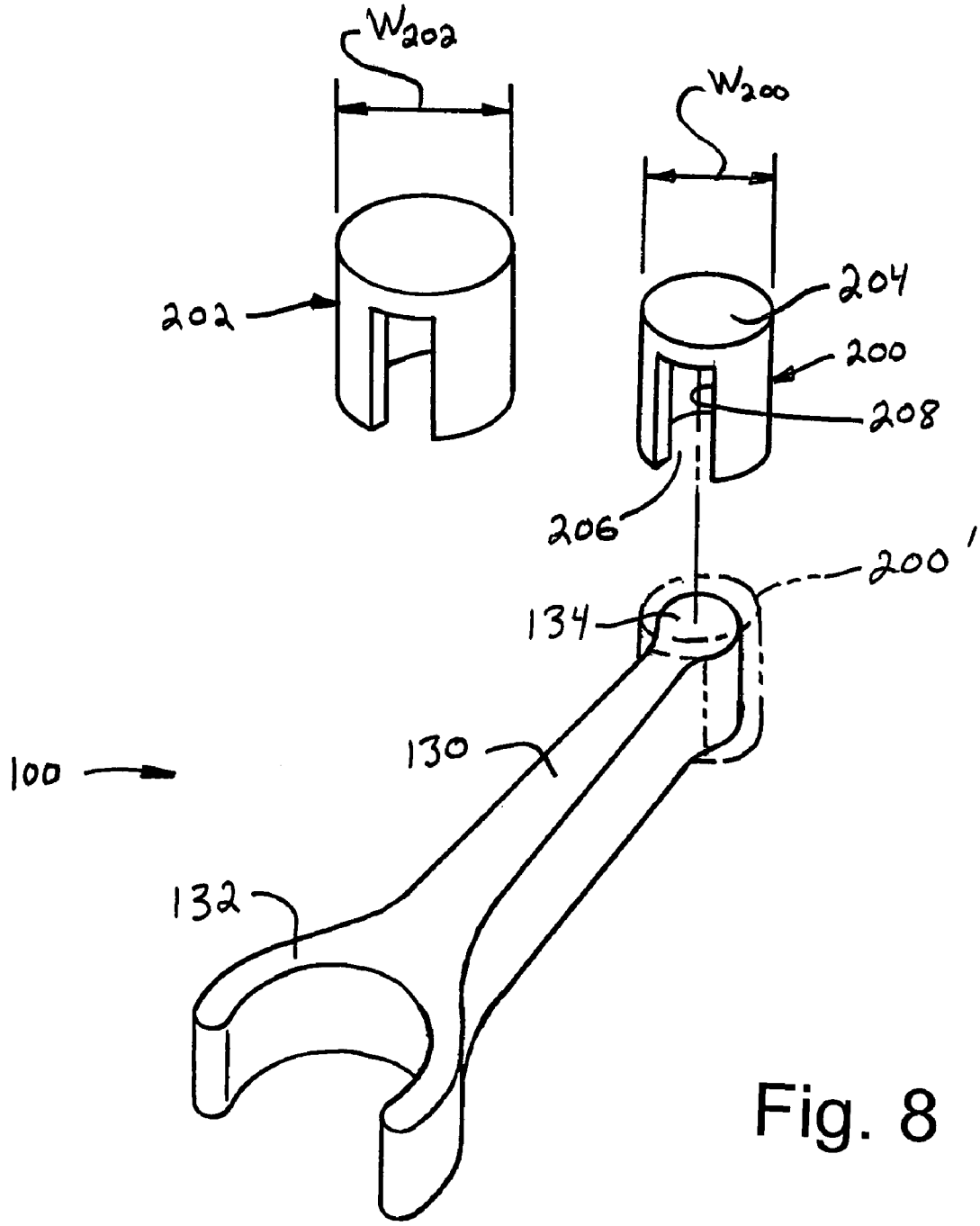
FIG. 8 is an exploded view of another embodiment of an alignment device, including one or more caps which are removably mounted on the sighting structure to alter the visible width of the sighting structure.

There is illustrated in FIG. 8, an alternate embodiment of an alignment device, indicated generally at 100, which is similar in function and structure as the alignment device 10, and as such similar 100 series and 10 series numbers indicate similar features. The alignment device 100 includes a body 130, a clamping portion 132, and a sighting structure 134. Preferably, the alignment device 100 comes in a kit in which a plurality of caps, such as caps 200 and 202 shown in FIG. 8, may be used to cover the sighting structure 134, as shown by phantom lines 200'. The plurality of caps preferably have different widths, such as widths $W_{200}$ and $W_{202}$ for the caps 200 and 202, respectively, illustrated in FIG. 8, for altering the overall visual width of the sighting structure. Thus, the alignment device 100 and the caps 200 and 202 can be packaged and sold as a kit in which the user can mount different caps onto the alignment device 100 for altering the visual width of the sighting structure underneath the shaft 16. Thus, the width of the sighting structure 134 would have the smallest width.

The caps 200 and 202, or more of a plurality of caps, can have any suitable shape which accommodates the mounting of the cap to the sighting structure 134. Preferably, the caps are removably mounted on the sighting structure 134 by a frictional resilient engagement. In the illustrated embodiment of FIG. 8, the cap 200 has a generally hollow cylindrical shape having a capped top 204, an open bottom 206, and a slot 208. The slot 208 is formed in a portion of a cylindrical wall of the cap 200. The slot 208 extends upwardly from an edge of the open bottom 206. When mounted on the sighting structure 134, the slot 208 of the 200 receives a portion of the second end 142 of the body 130 to accommodate the second end, as shown by phantom lines 200'.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A golf club and an alignment device comprising:

a golf club including a shaft having an end and a head extending from said end of said shaft in a first direction;

an alignment device including an attachment portion attached to said shaft and a sighting structure extending from said attachment portion, said sighting structure extending from said shaft in a second direction that is generally opposite to said first direction, said sighting structure being hidden by said shaft when viewed by a user gripping said golf club to address a ball; and a plurality of caps adapted to be mounted on said sighting structure, wherein each of said plurality of caps is configured with different widths.

2. The golf club and alignment device of claim 1, wherein said shaft has a diameter, and wherein said sighting structure has a width that is equal to or less than a diameter of said shaft.

3. The golf club and alignment device of claim 1, wherein said alignment device includes a body portion having first and second ends, and wherein a clamp portion extends from said first end and said sighting structure extends from said second end.

4. The golf club and alignment device of claim 3, wherein said sighting structure extends from an extreme end of said second end of said body.

5. The golf club and alignment device of claim 3, wherein said golf club is a putter.

6. The golf club and alignment device of claim 3, wherein said body portion is elongated and has a width that is less than a diameter of the shaft.

7. The golf club and alignment device of claim 3, wherein said clamp portion includes a pair of arcuate arms having ends converging with one another, and wherein said ends of said arms are spaced apart by a distance less than a diameter of said shaft.

8. The golf club and alignment device of claim 1, wherein said sighting structure is formed in the general shape of a cylinder having a diameter that is less than a diameter of said shaft.

9. The golf club and alignment device of claim 1, wherein said sighting structure is formed in a general shape of a sphere having a diameter that is less than a diameter of said shaft.

10. The golf club and alignment device of claim 1, wherein said caps are removably mounted on said sighting structure.

11. The golf club and alignment device of claim 1, wherein said caps have a hollow generally cylindrical shape.

12. The golf club and alignment device of claim 1, wherein said alignment device includes a body portion having first and second ends, a clamp portion extending from said first end and said sighting structure extending from said second end, and wherein said caps include a slot formed therein, said caps being mounted over said sighting structure such that said slot receives a portion of said second end of said body.

13. A golf club alignment device comprising:

a body having first and second ends;

a clamp portion extending from said first end of said body adapted for attachment to the shaft of a golf club;

a sighting structure extending from said second end of said body; and a cap having a hollow shape and including a slot formed therein, said cap mounted over said sighting structure such that said slot receives a portion of said second end of said body.

14. The alignment device of claim 13 further including a plurality of caps adapted to be mounted over said sighting structure, wherein each of said plurality of caps is configured with different widths.

15. The alignment device of claim 13, wherein said cap has a hollow cylindrical shape.

16. The alignment device of claim 13, wherein said sighting structure extends from an extreme end of said second end of said body.

17. A golf club and an alignment device comprising:

a golf club including a shaft having an end and a head extending from said end of said shaft in a first direction;

an alignment device including a body portion having first and second ends, a clamp portion extending from said first end and said sighting structure extending from said second end, said clamp portion defining an attachment portion attached to said shaft and a sighting structure extending from said attachment portion, said sighting structure extending from said shaft in a second direction that is generally opposite to said first direction, said sighting structure being hidden by said shaft when viewed by a user gripping said golf club to address a ball; and a cap mounted on said sighting structure, wherein said cap includes a slot formed therein, said cap being mounted over said sighting structure such that said slot receives a portion of said second end of said body.

18. The golf club and alignment device of claim 17, wherein said shaft has a diameter, and wherein said sighting structure has a width that is equal to or less than a diameter of said shaft.

19. The golf club and alignment device of claim 17, wherein said alignment device includes a body portion having first and second ends, and wherein a clamp portion extends from said first end and said sighting structure extends from said second end.

20. The golf club and alignment device of claim 17, further including a plurality of caps adapted to be mounted on said sighting structure, wherein each of said plurality of caps is configured with different widths.

* * * * *